United States Patent [19]

Paulson et al.

[11] Patent Number: 4,973,091

[45] Date of Patent: Nov. 27, 1990

[54] SLIDING PATIO DOOR DUAL POINT LATCH AND LOCK

[75] Inventors: Gary F. Paulson, Waseca; Thomas A. Cloutier, Faribault; Eugene L. Mosher, Owatonna, all of Minn.

[73] Assignee: Truth Incorporated, Owatonna, Minn.

[21] Appl. No.: 409,708

[22] Filed: Sep. 20, 1989

[51] Int. Cl.[5] ..... E05C 9/12

[52] U.S. Cl. ..... 292/51; 292/916.46; 292/216

[58] Field of Search ..... 292/216, 99, 198, 44, 292/45, 46, 47, 48, 49, 51, 52, 53, DIG. 46

[56] References Cited

U.S. PATENT DOCUMENTS

| | | | |
|---|---|---|---|
| 1,131,247 | 3/1915 | Kiekert | 292/51 |
| 3,040,555 | 6/1962 | Wartian | 292/DIG. 46 X |
| 4,273,368 | 6/1981 | Tanaka | 292/53 |
| 4,362,328 | 12/1982 | Tacheny et al. | 292/36 |
| 4,643,005 | 2/1987 | Logas | 292/DIG. 46 X |

FOREIGN PATENT DOCUMENTS

| | | | |
|---|---|---|---|
| 191850 | 10/1907 | Fed. Rep. of Germany | 292/45 |

*Primary Examiner*—Eric K. Nicholson

*Attorney, Agent, or Firm*—Wood, Phillips, Mason, Recktenwald & VanSanten

[57] ABSTRACT

A latch mechanism for a patio door having a narrow rectangular frame surrounding a window and slidable in a casing so that a vertical frame side abuts the casing when the door is closed. A pair of vertically spaced keepers on the casing are engagable by a pair of spaced latches on the door frame. The latches are biased toward an open position, and are moved by the keepers to a latching position when the door is closed. Catches secure the latches in the latching position, and the door handles are operably connected to the catches by a pair of longitudinally movable tie bars and pivoting links. A locking cam gear is movable by a sliding rack actuator between an unlocked position clear of the tie bars and a locked position with a raised cam surface engaging the tie bars to prevent longitudinal movement of the tie bars.

23 Claims, 4 Drawing Sheets

Fig. 1
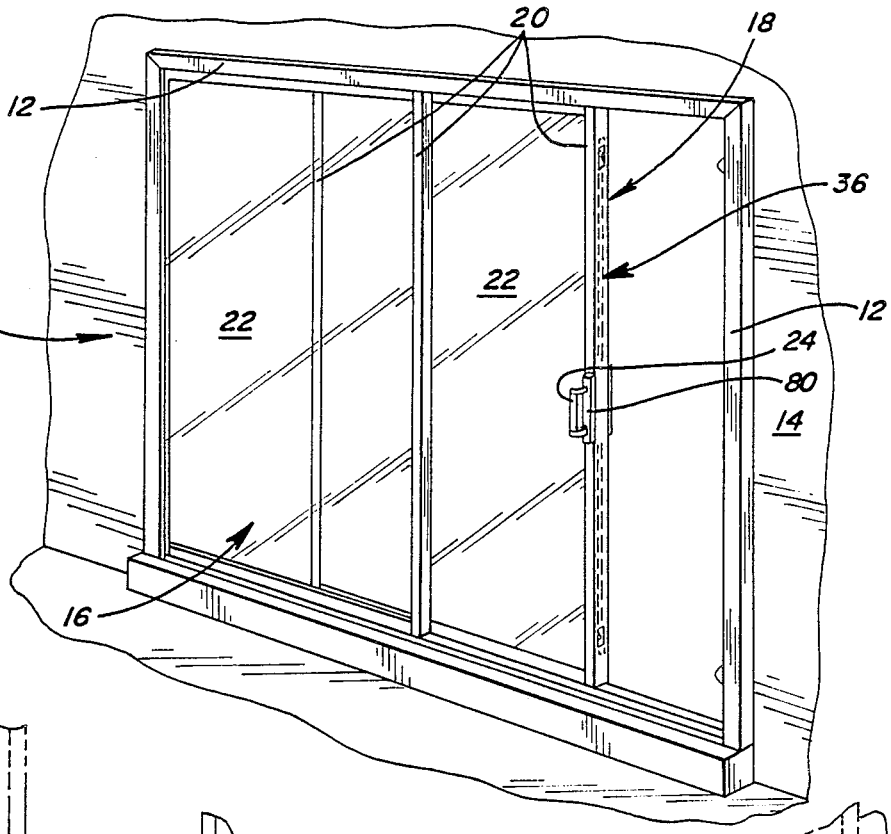
Fig. 2
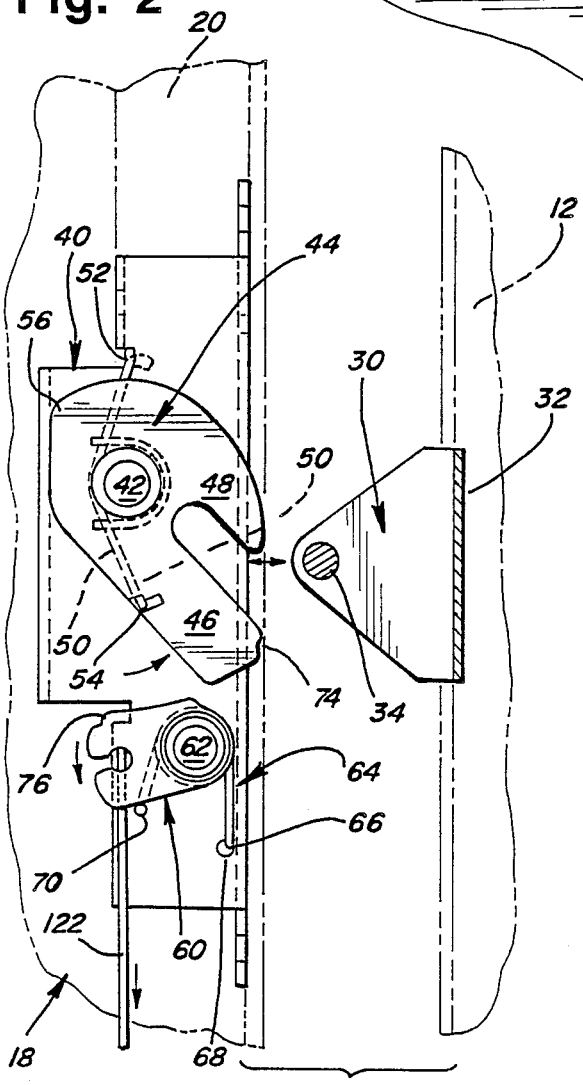
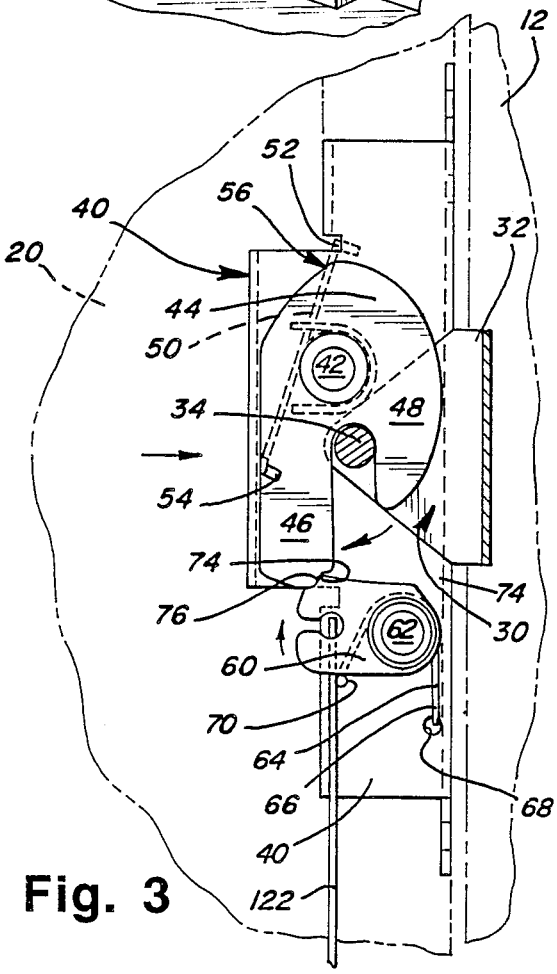
Fig. 3

SLIDING PATIO DOOR DUAL POINT LATCH AND LOCK

DESCRIPTION

1. Technical Field

The present invention relates to sliding patio doors, and more particularly to a latch and lock mechanism for sliding patio doors.

2. Background of the Invention

Patio doors are, of course, well known in the art, having a stationary door and a sliding door which allows entry into and exit out of the home. It is particularly desirable that such doors have a maximum amount of glass so as to provide the open feeling to the home which is sought in homes having such doors.

Commonly, such doors have been provided with a simple lock mechanism which includes a finger which grasps a keeper on the door casing when locked by an operator inside the home. While such locks provide some security, they can relatively easily be opened by an intruder by simply drilling into the housing of the lock and moving the finger free of the keeper.

Further, when such doors are closed without being locked, it is often not readily apparent whether the doors have been completely shut, or when they are slammed shut, they can rebound slightly to leave an open gap. In either event, the door does not serve as a good seal against heat (or air conditioning) loss, and further does not act as a barrier against entry of dirt, water, and insects into the home. In some instances, the door can be unintentionally gapped open enough that the locking finger will miss the keeper when seemingly locked, thereby providing the homeowner with a dangerous false sense of security.

Another patio door structure which has been used is shown in U.S. Pat. No. 4,362,328. This structure provides a secure lock for patio doors, but does not prevent the problems which can be encountered when the door is intentionally left unlocked—namely, the presence of unintentional gaps when closing the door through which heat and air conditioning can be lost and through which dirt, water and insects can enter the home.

The present invention is directed toward overcoming one or more of the problems set forth above.

SUMMARY OF THE INVENTION

In one aspect of the present invention, a latch mechanism is provided for a patio door having a narrow rectangular frame surrounding a window and slidable in a casing so that a vertical frame side abuts the casing when the door is closed. A pair of vertically spaced keepers are fixed on the casing, and are engagable by a pair of vertically spaced latches on the door frame. The latches are biased toward an open position, and are moved by the keepers to a latching position when the door is closed. Catches secure the latches in the latching position, and the door handles are operably connected to the catches to release the latches to their open position when a handle is engaged to open the door.

In another aspect of the present invention, the door handles are mounted to allow slight movement when engaged to open the door, and the movement of the handle releases the latches.

In still another aspect of the present invention, the handles are connected to the catches by a pair of tie bars which extend oppositely from the handle along the frame to the spaced latches. Movement of a handle moves the bars longitudinally to disengage the catches from the latches.

Another aspect of the present invention is the provision of the operative connection between the handles and the tie bars by pivotable offset links. The links engage the handles to pivot in response to slight movement of either handle, and the links are further connected to the tie bar to bias the tie bar longitudinally in response to pivoting of the link.

In yet another aspect of the present invention, a locking cam gear is provided to move between an unlocked position clear of the tie bars and a locked position with a raised cam surface engaging the tie bars to prevent longitudinal movement of the tie bars. A sliding rack actuator engages the cam gear and is operable from the inside side of said door to move the cam gear between its locked and unlocked positions.

The present invention provides secure latching and locking against forced entry through the patio door.

The present invention also provides that the patio door will be automatically latched when closed, and yet can still be easily operated to open the door when desired, even when the operator is panicked in an emergency.

The present invention can further be easily installed in a variety of patio doors without significantly cutting down on the window space in the door.

BRIEF DESCRIPTION OF THE DRAWINGS

FIG. 1 is a perspective view of a patio door embodying the present invention;

FIG. 2 is a cross-sectional view of the upper latch and keeper of the present invention in the door open position;

FIG. 3 is a cross-sectional view similar to FIG. 2, but with the door in its closed position;

DESCRIPTION OF THE PREFERRED EMBODIMENT

Figures 4, 5:
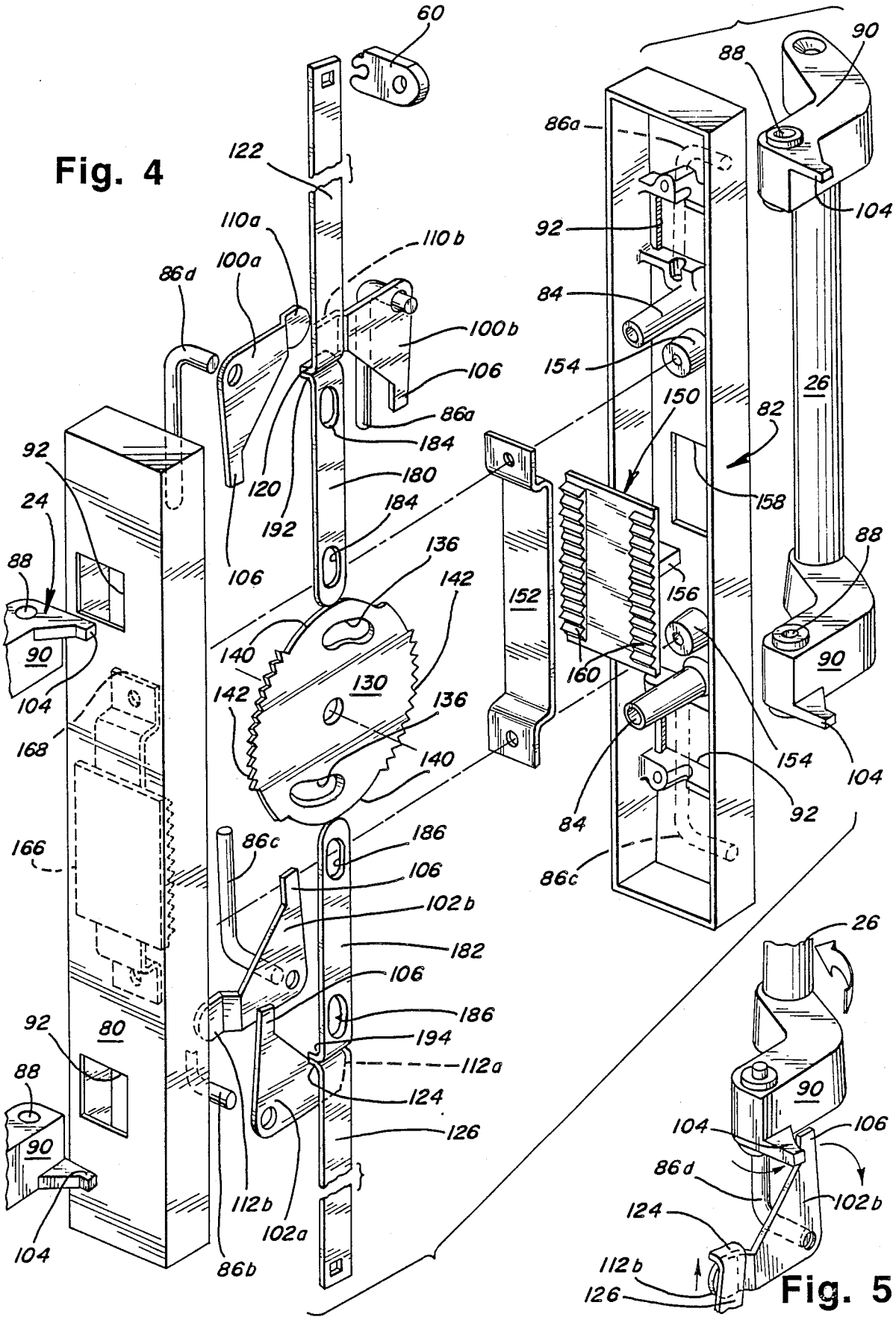
FIG. 4 is an exploded view of the handle and latch operating mechanism of the present invention.
FIG. 5 is a partial perspective view showing the handle, offset link, and tie bar cooperation in the operating mechanism.

A patio door structure 10 embodying the present invention is shown in FIG. 1. A casing 12 is provided in the house 14, with a stationary door 16 and a sliding patio door 18 allowing for ingress and egress through the door structure. Conventionally, each of the doors 16, 18 will have a relatively narrow frame 20 surrounding a transparent panel 22 of glass or the like. An outer handle 24 is provided on the exterior side of the sliding door 18 and an inner handle 26 (see FIGS. 4-7) is provided on the interior side of the sliding door 18.

A pair of keepers 30 are fixed to the side of the casing 12 against which the sliding door 18 abuts when closed, with one of the keepers being disposed near the bottom of the casing 12 and the other near the top. As best seen in FIGS. 2 and 3, the keepers 30 preferably consist of a U-bracket 32 with a rod 34 secured therebetween.

The latch mechanism 36 of the present invention is provided along the side of the door frame 20 which abuts the casing 12 when the door 18 is closed. As will become apparent to those skilled in the art once an understanding of the present invention is obtained, the latch mechanism 36 is longitudinally disposed so as to require very little space along the door frame 20. Thus, the mechanism 36 will allow for the maximum size glass panel 22 (i.e., it will not require a wide frame portion), a particularly important consideration with patio doors where such visibility is desired.

It will also be understood by those skilled in the art that while the latch mechanism 36 of the present invention can be disposed in a routed indentation of a door frame, it can also be provided in a narrow, preassembled housing which is merely secured to the side of the door frame 20 (thereby eliminating any need for routing of the door frame).

The latching of the present invention will now be described with reference to FIGS. 2 and 3. The upper keeper 30 is shown in these Figures, though it should be understood that the lower keeper would be identically grasped by the latch mechanism 36 (though the mechanism 36 would be inverted).

A latch housing 40 which is fixed relative to the frame 18 mounts a pivot pin 42 about which a latch 44 may pivot. The latch 44 is hook shaped with a shank 46 and a grasping portion 48.

A torsion spring 50 having one end 52 bearing against the latch housing 40 and another end 54 bearing against the latch 44 biases the latch 44 counterclockwise as shown in FIGS. 2 and 3. The latch 44 is suitably restrained against counterclockwise pivoting beyond the position shown in FIG. 2, such as by the shoulder portion 56 of the latch 44 which abuts the latch housing 40 as shown.

A latch catch 60 is also pivotable about a pivot pin 62 secured to the latch housing 40. A torsion spring 64 having one end 66 suitably bearing against the latch housing 40 (as by a portion extending through a hole 68 in the housing 40 as shown) and the other end 70 bearing against the latch catch 60 biases the latch catch 60 clockwise as shown in FIGS. 2 and 3. Clockwise pivoting of the catch 60 is limited by the abutment of the catch 60 with the latch 44. (It should be understood that the catch 60 in FIG. 2 is being pulled down against the force of the torsion spring 64 as will hereafter be described.)

The latch 44 includes an ear 74 and the latch catch 60 includes a shoulder 76 adapted to engage the latch ear 74 to maintain the latch 44 in its grasping (latching) position as shown in FIG. 3.

Thus, operation of the latch 44 is as follows. When the door 18 is open, the latch 44 is pivoted to the position shown in FIG. 2 with its grasping portion 48 vertically above the keeper rod 34. When the door 18 is closed (by moving it to the right in FIG. 2), the shank 46 of the latch 44 first engages the the keeper rod 34, causing the latch 44 to pivot clockwise as the door 18 is moved further closed. Pivoting of the latch 44 causes the grasping portion 48 to wrap around the keeper rod 34 until, with the door 18 completely shut, it grasps the keeper rod 34 as shown in FIG. 3. In that position, the latch ear 74 has cleared the catch shoulder 76 so that the catch 60 is also biased up by its torsion spring 64 into the position shown in FIG. 3.

Accordingly, in the latched position shown in FIG. 3, the latch 44 is fixed in its grasping position by the abutment of the catch shoulder 76 against the latch ear 74. Thus, the door 18 is positively latched, and cannot be opened until the latch 44 is released by the catch 60 in a manner as will be described hereafter.

Reference will now be made to the operator used to unlatch the latches 44 for opening the door 18 when closed.

As best shown in FIG. 4, a pair of housings 80, 82 (see also FIG. 1) are provided on opposite sides of the door 18. Raised bosses 84 (seen only on the inner housing 82) are provided through which suitable screws (not shown) may be extended so that the housings 80, 82 can be secured on opposite sides of the door frame 20.

The handles 24, 26 are secured to interior of the respective housings 80, 82 by L-pins **86*a–d*, one leg of which extends through a boss 88 on the arms 90 of the handles 24, 26. The handles 24, 26** may thus pivot about a vertical axis.

The housing openings 92 through which the handle arms 90 extend are preferably only slightly bigger than the arms so as to limit the handles 24, 26 to only slight pivoting. Once an understanding of the present invention is obtained, it will be appreciated by those skilled in the art that this mechanism will only require slight movement of either handle 24, 26 to unlatch the door 18. Such "slight" movement not only allows the handles 24, 26 to provide a solid feel, but also ensures that the person opening the door 18 will not pinch his hand between the handle 24 or 26 and the door 18 when opening the door 18.

The other leg of the L-pins **86*a–d* mount upper offset links 100*a–b* and lower offset links 102*a–b* for pivoting about a horizontal axis. The L-pins 86*a–d* are suitably secured in the housings 80, 82, as by mounting plates (not shown) over the pins 86*a–d***.

The handle arms 90 further each include an ear 104 which abuts an ear 106 on the links **100*a–b*, 102*a–b* such that pivoting of a handle 24, 26 will also pivot its associated links 100*a*, 102*a* or 100*b*, 102*b* (see especially FIG. 5**).

The upper links **100*a–b* each include an offset ear 110*a–b*, and the lower links 102*a–b* also each include an offset ear 112*a–b*. The ears 110*a–b* of the upper links 100*a–b* engage the top of a flange 120 of an upwardly extending tie bar 122, and the ears 112*a–b* of the lower links 102*a–b* engage the bottom of a flange 124 of a downwardly extending tie bar 126**.

Figure 8:
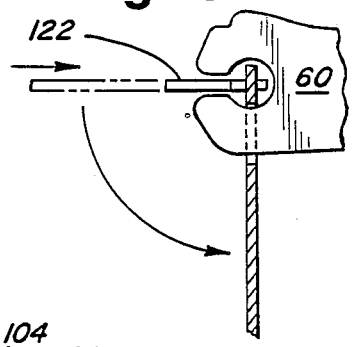
FIG. 8 is a partial view showing the connection of the tie bar to the latch catch.

The tie bars 122, 126 extend to t lower ends of the latch mechanism 36 and are secured to the latch catches 60 associated with each latch 44 (see FIG. 8) such that longitudinal (vertical) movement of the tie bars 122, 126 will cause the latch catches 60 to pivot about their pins 62.

Operation of this structure is thus as follows.

Figure 6:
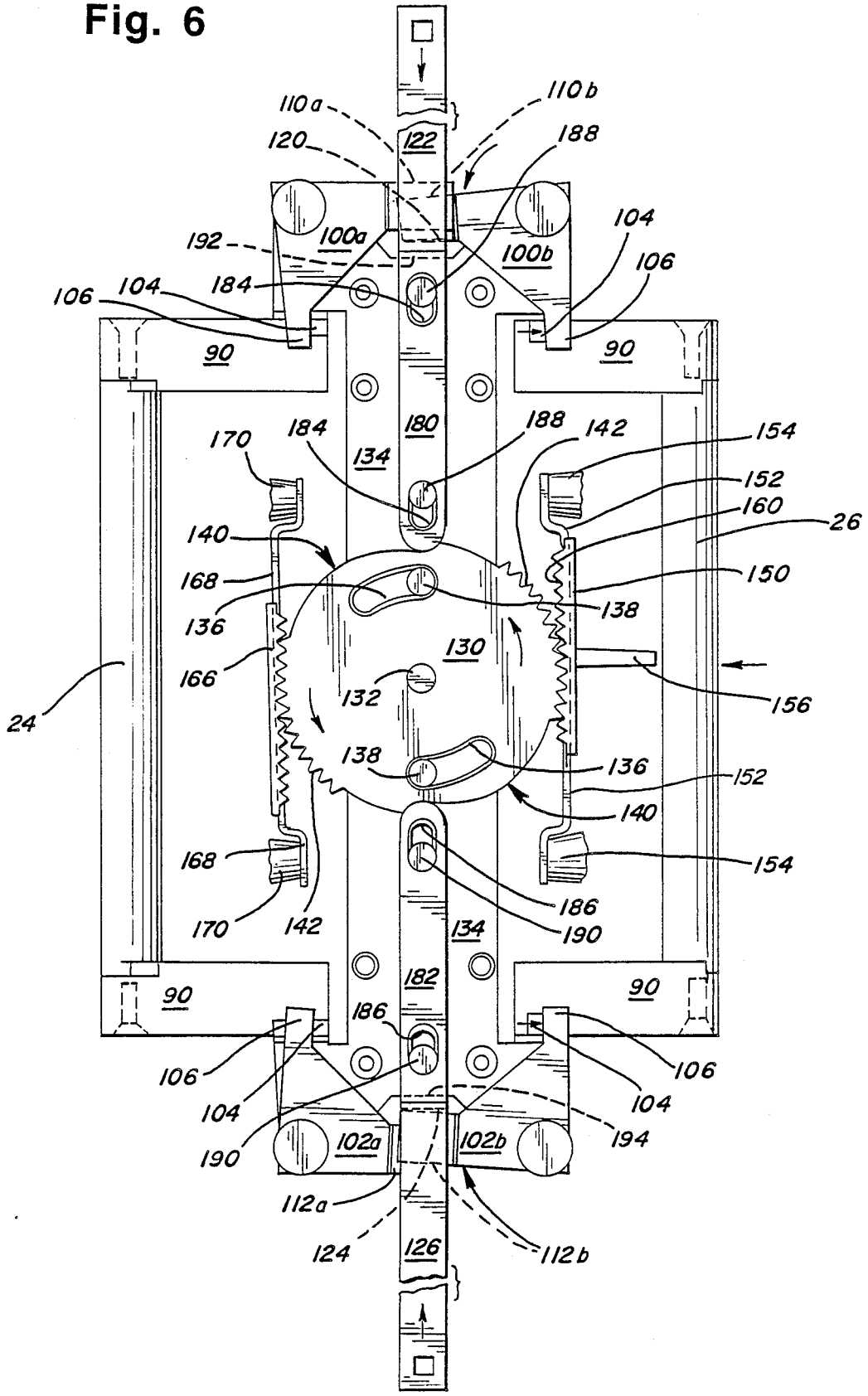
FIG. 6 is a plan view of the latch operating mechanism in the unlocked position.

When a person grasps the inner handle 26 and pulls the handle 26 toward opening the door 18 (toward the back and left in FIG. 4), the handle 26 will pivot slightly about a vertical axis. This slight pivoting of the handle 26 causes the ears 104 on the handle arms 90 to also move slightly (back and to the right in FIG. 4), as shown in FIG. 6.

The handle ears 104 thus engage the ears 106 of the associated links **100*b*, 102*b*, pivoting the upper link 100*b* so that its offset ear 110*b* engages the flange 120 to pull the upper tie bar 122 down and pivoting the lower link 102*b* so that its offset ear 112*b* engages the flange 124 to pull the lower tie bar 126** up.

This movement of the tie bars 122, 126 causes the connected latch catches 60 to pivot so as to release the latches 44, which will then be able to pivot free of the keeper rod 34 (to the position shown in FIG. 2) as the door 18 slides open.

The operation is similar when the outer handle 24 is pulled toward opening the door 18, with the tie bars 122, 126 being moved by the other upper and lower links 100*a*, 102*a*.

Reference will now be made to the locking mechanism which prevents unauthorized opening of the door 18 from the outside when such operation is desired.

Figure 7:
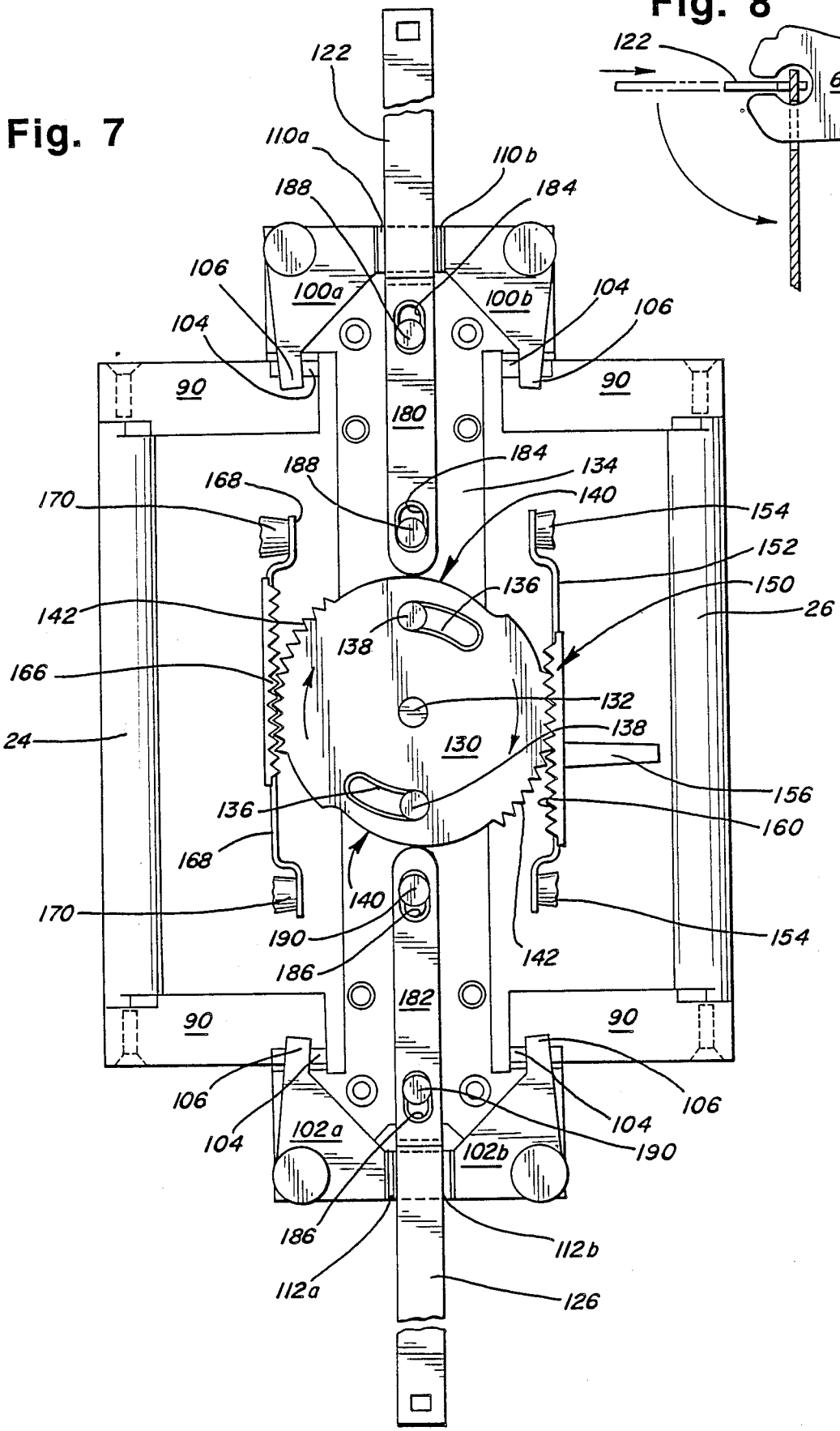
FIG. 7 is a plan view similar to FIG. 6, but showing the latch operating mechanism in the locked position.

A cam gear 130 is pivotably mounted to a pin 132 on the transversely extending handle mounting plate 134 (see FIGS. 6 and 7). The cam gear 130 further includes a pair of arcuate slots 136 which cooperate with a pair of stops 138 on the mounting plate 134 to limit pivoting of the cam gear 130 between an unlocked position (FIG. 6) and a locked position (FIG. 7).

The circumference of the cam gear 130 includes cam surfaces 140 on its top and bottom and gear teeth 142 on the sides. The cam surfaces 140 have a varying radius around the axis of pivoting of the cam gear 130 (as defined by the pin 132) as described hereafter.

A rack actuator 150 is mounted to the inner housing 82 by a mounting plate 152 secured to bosses 154 on the inside of the housing 82. As best illustrated in FIG. 4, the actuator 150 includes a thumb knob 156 which projects into the home interior through the opening 158 in the housing 82. The opening 158 is elongated so that a person in the home can slide the actuator up and down between locked and unlocked positions (as will be apparent).

The inner surface of the actuator 150 includes gear teeth 160 which engage the gear teeth 142 of the cam gear 130 so that vertical movement of the actuator 150 pivots the cam gear 130.

As will be apparent to those skilled in the art with an understanding of the present invention, the gear teeth 160 on only one side of the actuator 150 will engage the cam gear teeth 142. However, provision of two sets of actuator gear teeth 160 (as shown in FIG. 4) makes the unit readily adaptable for use with any door, whether right hand or left hand closing.

A rack 166 is mounted to the outer housing 80 by a similar mounting plate 168 and bosses 170, and engages the other cam gear teeth 142. The rack 166 may be operated by a tie bar connected to a key lock (not shown) accessible from the outside, whereby a key can be used to slide the rack 166 vertically to pivot the cam gear 130 to either its locked or unlocked positions, as desired.

Secured for vertical reciprocation on the handle mounting plate 134 are an upper lock link 180 and a lower lock link 182. The links 180, 182 include vertical slots 184, 186 within which are received guide pins 188, 190. One end of each lock link 180 rides on a cam surface 140 of the cam gear 130. The opposite end of each lock link 180, 182 includes a flange 192, 194 which abuts respective tie bar flanges 120, 124 (see FIG. 4).

Operation of this lock structure is thus as follows.

In the unlocked position as shown in FIG. 6, the rack actuator 150 is positioned so that the lock links 180, 182 are seated on that portion of the cam surface 140 of the cam gear 130 which has the shortest radius. Thus, the upper lock link 180 is free to travel to its lowest position and the lower lock link 182 is free to travel to its highest position (although gravity will generally keep the lower lock link 182 down except during opening of the door 18). When either handle 24, 26 is then pulled toward opening the door 18, the tie bars 122, 126 are free to be moved along their axis as a result of pivoting of the associated offset links 100*a*, 102*a* or 100*b*, 102*b* to pull the catches 60 to free the latches 44.

In the locked position as shown in FIG. 7, however, the rack actuator 150 is positioned so that the lock links 180, 182 are seated on that portion of the cam surface 140 which has the larger radius (i.e., furthest spaced from the pivot axis of the cam gear 130). In this position, the lock links 180, 182 are maintained in their outermost positions (up for the upper link 180, down for the lower link 182). In this position, the flanges 192, 194 of the links 180, 182 abut the flanges 120, 124 of the tie bars 122, 126 to prevent them from being moved along their axis by the associated offset links 100*a–b*, 102*a–b*. Thus, when the door 18 is closed, pulling on either handle 24, 26 will not cause the catches 60 to release the latches 44, and the latches will therefore prevent the door 18 from being opened.

The above described structure provides a secure, positive feel latch when the door is closed, so that the door will not be unintentionally left with a gap when closed (whether as a result of unknowingly not closing the door far enough, or as a result of the door rebounding open slightly when slammed shut). Thus, the door will reliably serve as both a good seal against heat (or air conditioning) loss, and as a secure barrier to prevent undesirable entry of dirt, water, and insects into the home, all the while also being easily opened when so desired (even should the person be in a panic for some reason).

The above described structure further provides secure locking for the patio door which cannot be easily broken by an intruder. This structure still further provides a positive feel indicating that the door has been properly shut so that when the resident thinks he has locked the door, he can rest easy knowing that the door is in fact locked.

Other aspects, objects, and advantages of the present invention can be obtained from a study of the specification, drawings and appended claims.

We claim:

1. A latch mechanism for a sliding patio door having a narrow rectangular frame surrounding a window, where a vertical one of said frame sides abuts a vertical casing portion in the door closed position, comprising:

a handle mounted on said one vertical frame side;

first and second vertically spaced keepers fixed on said casing portion;

first and second vertically spaced latches on said one frame side, said latches being movable from a first position clear of said keepers to a second position grasping said keepers upon closing of said door;

means for biasing said latches toward their first position;

an ear on each of said latches;

latch catches biased toward said latches to engage said latch ears for retaining said latches in their second position;

means mounting said handle for allowing slight movement of said handle when said handle is engaged to open said door;

a first tie bar extending up said frame side from said handle and engaging the catch associated with the first latch;

a second tie bar extending down said frame side from said handle and engaging the catch associated with the second latch; and means for biasing said tie bars longitudinally toward moving the catches away from engaging said latch ear in response to said slight handle movement.

2. The latch mechanism of claim 1, further comprising means for locking said tie bars against longitudinal movement.

3. The latch mechanism of claim 2, wherein said locking means comprises a cam gear movable between an unlocked position clear of said tie bars and a locked position with a raised cam surface engaging said tie bars to prevent longitudinal movement of said tie bars.

4. The latch mechanism of claim 3, further comprising a sliding rack actuator engaging said cam gear and operable from the inside side of said door to move said cam gear between said locked and unlocked positions.

5. The latch mechanism of claim 1, wherein said biasing means for each of said tie bars comprises:

a pivotable link engaging the handle to pivot in response to slight movement of said handle, said link further being connected to the tie bar to bias said tie bar longitudinally in response to pivoting of said link.

6. The latch mechanism of claim 5, further comprising:

a second handle mounted on said one vertical frame side, one of said handles being located on the inside side of the door and the other of said handles being located on the outside side of the door; and for each of said tie bars a second pivotable link engaging the second handle to pivot in response to slight movement of said second handle, said second link further being connected to the tie bar to bias said tie bar longitudinally in response to pivoting of said second link.

7. The latch mechanism of claim 6, further comprising means for locking said tie bars against longitudinal movement.

8. The latch mechanism of claim 7, wherein said locking means comprises a cam gear movable between an unlocked position clear of said tie bars and a locked position with a raised cam surface engaging said tie bars to prevent longitudinal movement of said tie bars.

9. The latch mechanism of claim 8, further comprising a sliding rack actuator engaging said cam gear and operable from the inside side of the door to move said cam gear between said locked and unlocked positions.

10. A latch mechanism for a sliding patio door having a narrow rectangular frame surrounding a window, where a vertical one of said frame sides abuts a vertical casing portion in the door closed position, comprising:

a handle mounted on said one vertical frame side;

first and second vertically spaced keepers foxed on said casing portion;

first and second vertically spaced latches on said one frame side, side latches being movable from a first position clear of said keepers to a second position grasping said keepers upon closing of said door;

means for biasing said latches toward their first position;

means for retaining said latches in their second position;

means mounting said handle for allowing slight movement of said handle when said handle is engaged to open said door; and means for releasing said retaining means in response to said handle being engaged to open said door including a first tie bar extending up said frame side from said handle and engaging the retaining means associated with the first latch;

a second tie bar extending down said frame side from said handle and engaging the retaining means associated with the second latch; and means for biasing said tie bars longitudinally toward disengaging said retaining means in response to said slight handle movement.

11. The latch mechanism of claim 10, further comprising means for locking said tie bars against longitudinal movement.

12. The latch mechanism of claim 11, wherein said locking means comprises a cam gear movable between an unlocked position clear of said tie bars and a locked position with a raised cam surface engaging said tie bars to prevent longitudinal movement of said tie bars.

13. The latch mechanism of claim 12, further comprising a sliding rack actuator engaging said cam gear and operable from the inside side of said door to move said cam gear between said locked and unlocked positions.

14. The latch mechanism of claim 10, wherein said biasing means for each of said tie bars comprises:

a pivotable link engaging the handle to pivot in response to slight movement of said handle, said link further being connected to the tie bar to bias said tie bar longitudinally in response to pivoting of said link.

15. The latch mechanism of claim 14, further comprising:

a second handle mounted on said one vertical frame side, one of said handles being located on the inside side of the door and the other of said handles being located on the outside side of the door; and for each of said tie bars a second pivotable link engaging the second handle to pivot in response to slight movement of said second handle, said second link further being connected to the tie bar to bias said tie bar longitudinally in response to pivoting of said second link.

16. The latch mechanism of claim 15, further comprising means for locking said tie bars against longitudinal movement.

17. A latch mechanism for a patio door slidable in a casing, comprising:

an upper keeper and a lower keeper on the casing;

an upper latch and a lower latch on said door, said upper and lower latches grasping said upper and lower keepers respectively when the door is moved to its closed position to hold the door in that closed position;

inner and outer handles mounted on said door between said upper and lower latches; and an operator releasing said latches from grasping said keepers when either of said handles is pulled toward moving the door away from its closed position, including upper and lower latch catches biased toward said upper and lower latches respectively to retain said latches in their grasping position, tie bars connected to said latch catches, and means operatively connected to said handles for moving said tie bars longitudinally to move said latch catches away from retaining said latches when either of said handles is pulled toward moving the door away from its closed position.

18. The latch mechanism of claim 17, wherein said moving means comprises, with each tie bar, first and second pivotable links engaging the inner and outer handles respectively to pivot in response to slight movement of the engaged handle, said links further being connected to the tie bar to bias said tie bar longitudinally in response to pivoting of said link.

19. The latch mechanism of claim 17, further comprising means for locking said tie bars against longitudinal movement.

20. The latch mechanism of claim 19, wherein said locking means comprises a cam gear movable between an unlocked position clear of said tie bars and a locked position with a raised cam surface engaging said tie bars to prevent longitudinal movement of said tie bars.

21. A latch mechanism for a sliding patio door having a narrow rectangular frame surrounding a window, where a vertical one of said frame sides abuts a vertical casing portion in the door closed position, comprising:

means for mounting a handle on said one vertical frame side, said mounting means allowing slight movement of said handle when said handle is engaged to open said door;

first and second vertically spaced keepers fixed on said casing portion;

first and second vertically spaced latches on said one frame side, said latches being movable from a first position clear of said keepers to a second position grasping said keepers upon closing of said door;

means for biasing said latches toward their first position;

an ear on each of said latches;

first and second latch catches biased toward said first and second latches respectively to engage said latch ears when said latch is in its second position;

first and second tie bars longitudinally housed along said frame side from said handle and engaging the first and second catches respectively; and links between the handle and the tie bars, said links biasing said tie bars longitudinally toward moving the catches away from engaging said latch ears in response to said slight handle movement.

22. The latch mechanism of claim 21, further comprising a cam gear movable between an unlocked position clear of said tie bars and a locked position with a raised cam surface engaging said tie bars to prevent longitudinal movement of said tie bars.

23. The latch mechanism of claim 22, further comprising a sliding rack actuator engaging said cam gear and operable from the inside side of said door to move said cam gear between said locked and unlocked positions.

* * * * *